United States Patent [19]

Aurness et al.

[11] Patent Number: 4,650,033

[45] Date of Patent: Mar. 17, 1987

[54] GRAVITY IMPELLED PERSONAL LOWERING VEHICLE

[76] Inventors: Harold O. Aurness, 5808 Knox Ave. No., Brooklyn Center, Minn. 55430; Blaine F. Rowe, 5708 Ewing Ave. So., Edina, Minn. 55410; Arno J. Tremann, 1821 Mooring Line Dr., Vero Beach, Fla. 32960

[21] Appl. No.: 764,758

[22] Filed: Aug. 12, 1985

[51] Int. Cl.[4] ..... A62B 1/14

[52] U.S. Cl. ..... 182/7; 182/236

[58] Field of Search ..... 182/3–8, 182/231, 235, 236, 240; 188/65.1, 65.2, 65.4, 65.5

[56] References Cited

U.S. PATENT DOCUMENTS

| | | | |
|---|---|---|---|
| 269,268 | 12/1882 | Davis | 182/7 |
| 340,573 | 4/1886 | Hamlin et al. | 182/7 |
| 649,073 | 5/1900 | Racey | 182/7 |
| 725,206 | 4/1903 | Boisclaire | 182/7 |
| 1,671,527 | 5/1928 | Jones | 182/7 |
| 2,557,483 | 6/1951 | Tarasiuk | 182/7 |
| 4,106,589 | 8/1978 | Petersen | 182/5 |

*Primary Examiner*—Reinaldo P. Machado

[57] ABSTRACT

A descent vehicle for persons to lower themselves in a controlled manner by gravity from a high place or building on the outside. The unit rides on a rope secured to the building or high place and allows riders of different weights sitting on the seat of the vehicle holding on to handles to ride one at a time safely down from any height at about walking speed. Two main parts inside housing, pre-adjusted by the rider, bend and squeeze the rope to produce the desired safe descent speed. A hand brake on the unit is an additional safety feature.

6 Claims, 5 Drawing Figures

GRAVITY IMPELLED PERSONAL LOWERING VEHICLE

SUMMARY

A compact, harness-seat type vehicle to lower oneself by gravity from a high place or a building on fire in a quick, efficient manner using controlled descent mechanisms, hand holds and treated rope connected to a separate, moveable arm and having the ability to be put on or removed at any point on the rope without threading. Additional control is provided by a hand brake.

The device has a swivel handle on the front connected to a slotted swivel hub in a housing into which a rope is put vertically. When handle is turned to one of a number of holes selected by weight requirements, on an arc on face of housing, a pin connected to handle is inserted. This traps the rope and impedes the unit from moving on the rope but will not hold much weight until a turning screw mounted on the side of the housing and connected to a drag bar on the inside is tightened causing drag bar to be pressed hard against the rope near entrance point at bottom.

If the proper hole on the arc has been selected, the use may, after allowing the rope to fall, mount the vehicle without it moving and take himself out over empty space at any height, loosen the turning screw until movement is felt and ride the unit to the ground at about walking speed. He may use the hand brake mounted on the handle to slow or stop his descent if he meets an obstruction.

The unit may then be drawn back up by another person, repositioned on the rope and used again.

People of a wide range of weight may use the vehicle.

DESCRIPTION OF ILLUSTRATIONS

DESCRIPTION

Figure 3:
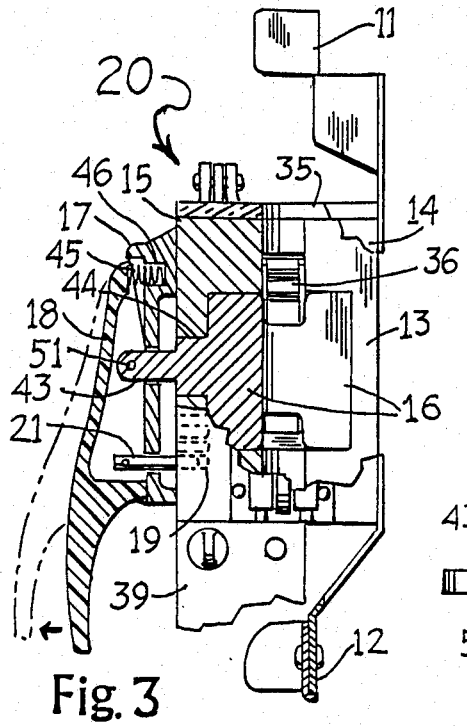
FIG. 3 shows a cross-sectional view of the lowering device according to section line 3—3 of FIG. 1.
Figure 4:
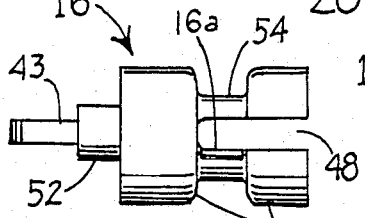
FIG. 4 shows a top view of the rope guide swivel hub.
Figure 5:
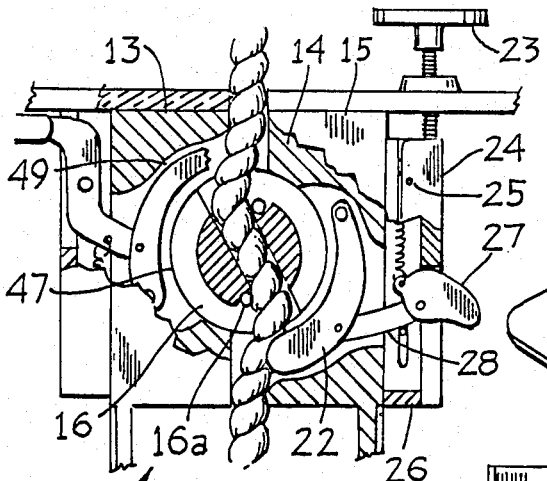
FIG. 5 shows a breakaway cross-sectional view of rope trapped in locked position in housing part.
Figure 1:
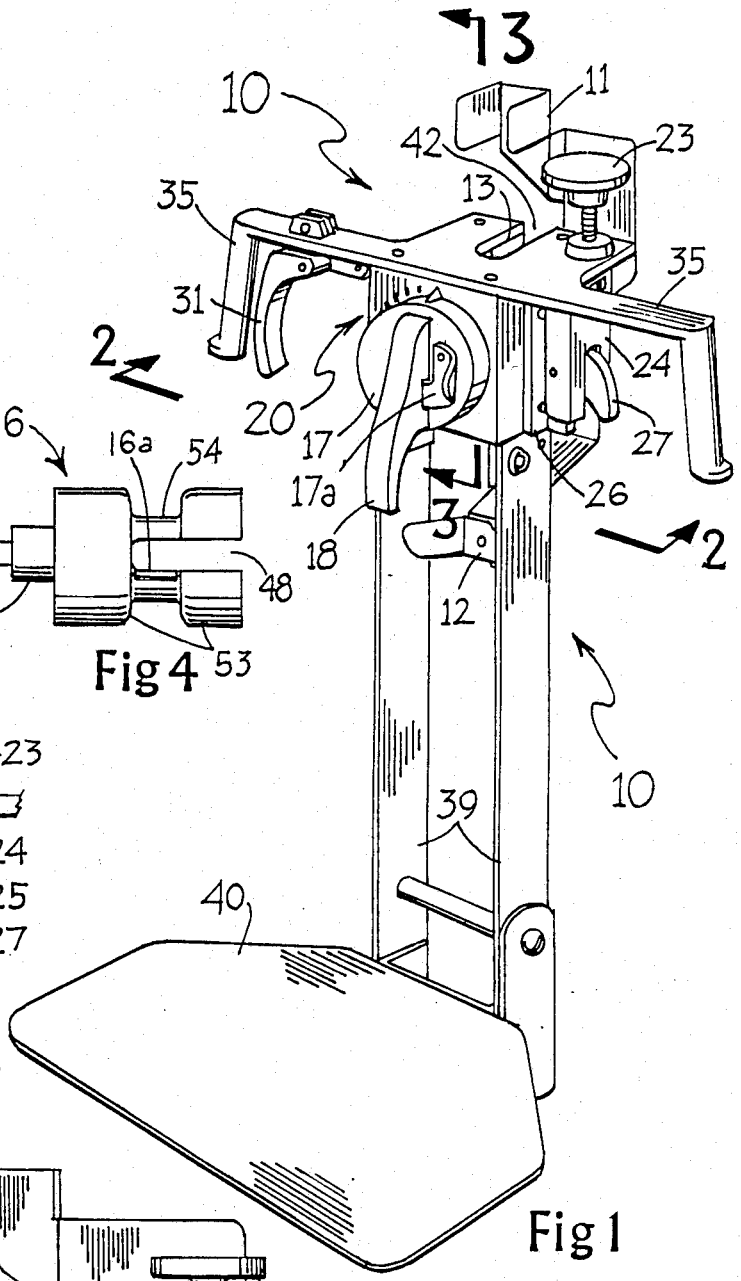
FIG. 1 shows a perspective view of a lowering device drawn according to the form of the present invention.
Figure 2:
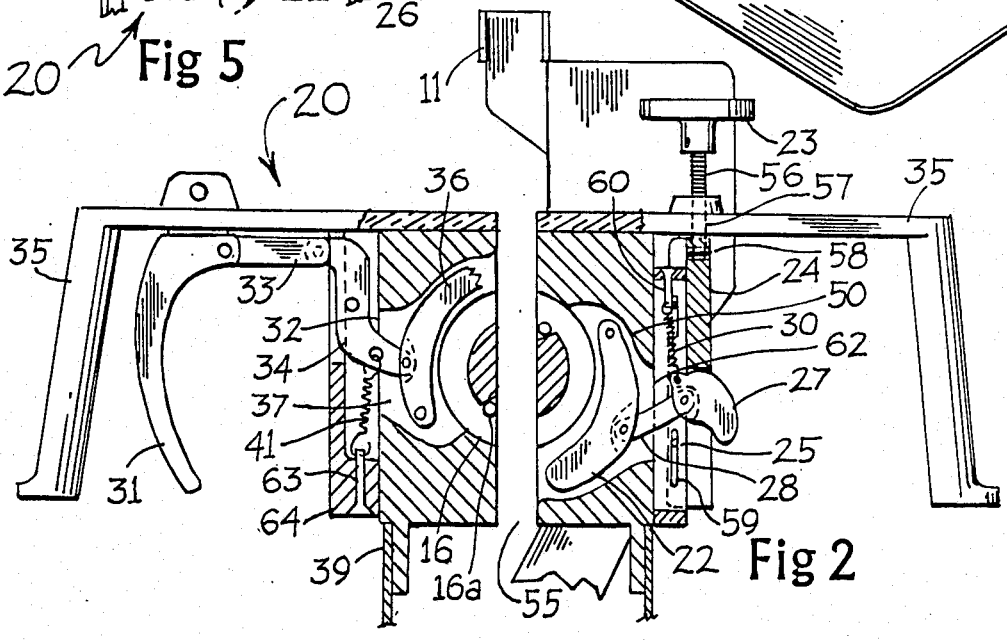
FIG. 2 shows a cross-sectional view of the lowering device according to section line 2—2 of FIG. 1.

A descent unit according to the teachings of the present invention is wholly shown in the drawings and generally designated 10. A rope used for descent, but not part of the invention, is bent around to inside of a rope guide 11 above unit 10 which forces the rope into a vertical slot 42 in unit housing generally designated 20 and out bottom of housing unit past a lower rope guide 12.

Rope is secured in place within unit housing 20 by turning the circular handle support housing 17 by means of rope lock handle 18, on the outside vertical face of unit housing 10 facing the rider, counter-clockwise to one of a series of holes on an arc 19 on lower face of unit housing 20 into which a pin 21, secured pivotally within rope lock handle 18, inserts itself horizontally. Rope lock handle 18 is secured pivotally in its upper central region to stem 43 of rope swivel hub 16 through an opening 65 in center of handle support housing 17. A pulling, turning action is required to release the rope lock handle 18 which returns to its lock position automatically by means of a free-floating compression spring 45 located in a depression 46 of handle support housing 17 where it meets top of rope lock handle 18.

Parts forming the unit housing 20 are housing locking blocks 13 and 14 and housing block 15 with housing locking blocks 13 and 14 secured by means to housing block 15 and facing each other to form a cylindrical chamber 47 to contain part of rope swivel hub 16 and to form vertical slot 42 in combination with a matching slot 48 in rope swivel hub 16, from top surface of housing to bottom surface and horizontally from inside surface of housing block 15 to outside surfaces of housing locking blocks 13 and 14. Shaped depressions 49 and 50 on the inside surfaces of housing locking blocks 13 and 14 facing housing block 15 make space for brake bar 36 and lock drag bar 22 respectively to move within the unit housing 20.

The rope swivel hub 16 centered within cylindrical chamber 47 in unit housing 20 is designed to bend rope trapped in its slot 48 to meet weight categories of riders of different weights. It is formed of a stem 43 with a rectangular cross-section extending outwardly to attach by connecting means 51 to rope lock handle 18 from the center of the end of a larger cylindrical neck 52 which fits into hole 44 centrally located in housing block 15. Neck 52 extends to center of end of a larger cylindrical shape 53 which is divided midway along its length by a groove 54 encircling its circumference. A slot 48 to hold rope wholly divides the larger cylinder 53 equally from the outside to and through groove 54. Two roller pins 16A are positioned diametrically on opposite corners of the slot 48 at the groove to facilitate rope movement.

Helping to lock the rope in place within housing unit 20 is the lock drag bar 22 attached pivotally at its top end within space 50 and arches downward to meet rope near entrance point 55 at bottom of housing unit where it crimps the rope tightly enough to hold a rider motionless on the unit when in tightened or locked position.

Lock drag bar 22 is activated by turning the lock turning knob 23 above unit handle 35 clockwise which turns a screw 56 connected vertically through threaded hole 57 in unit handle 35 to the movable lock housing 24 by means which allows screw end to rotate freely in hole 58 in top of movable lock housing 24. The lock housing 24 which covers the full length of the stationary lock mount 26 on side of housing unit 20 is attached to said stationary lock mount by two pins 25 secured to sides of movable lock mount 24 near the top and bottom and extending horizontally through elongated vertical slots 59 on both sides of stationary lock mount 26. This arrangement enables the movable lock housing 24 to move up or down within the limits of the slots 59 which activates the lock and spring swivel 27. The lock and spring swivel 27 which is generally kidney shaped, is rounded at the top to enable it to slide easily under bottom of movable lock housing 24 and is connected by a tension spring 30 from its top to a rivet 60 or other means inside the stationary lock mount 26 at the top and pivotally to a central part 61 of the lock drag bar 22 by a lock pressure arm 28 located in space 50 through opening 62. Downward movement of movable lock housing 24 tilts the top of the lock and spring swivel 27 down and inward pushing the lock drag bar 22 inward toward rope. Tension spring 30 pulls the lock and spring swivel 27 back to upright position when pressure from movable lock housing 24 is released.

To descend, the rider sitting on the folding seat 40 attached to housing unit 20 by extender parts 39 must slowly turn lock turning knob 23 counter-clockwise. This allows tension spring 30 to pull up movable lock and spring swivel 27 by releasing the pressure put on it by the movable lock housing 24 which in turn pulls the lock drag bar back from its pressure position on rope allowing unit 10 to gradually start to descend about walking speed.

The hand brake 31 attached on unit handle 35 extends pressure to rope in housing 20 through opening 32 by means of linkage members 33 and 34 attached to brake bar 36 in area 37 by squeezing handle of hand brake 31 back to unit handle 35. This causes top of brake bar 36 which is anchored at bottom end by pin 38 to move inward toward rope exit point and put pressure on rope. Brake bar is brought back to original position by tension spring 41 secured to rivet 63 or other means inside bottom of brake arm housing 64 on vertical side face of unit housing 20.

What is claimed:

1. A device designed to be attached to a rope of a certain size for lowering oneself from a high place at a safe speed, to be easily removed for reuse, comprising a base housing member of several attached pieces featuring a transecting vertical slot to accept a rope, a cylindrical rope swivel hub featuring a slot extending diametrically through the axis matching in width and position the transecting slot in the housing member and positioned horizontally within the housing member so as to be rotatable around the axis for the purpose of crimping, or bending, the rope to impede movement or to straighten the rope for disengagement, means for preventing rotational return movement of the rope swivel hub by employment of a lock handle attached to an extension of the rope swivel hub member outside the housing member which said lock handle also simultaneously sets and locks the swivel hub member in the right angle around its axis required by the weight category of the rider, a circumferentially placed groove in the swivel hub member to receive the rope at the apex of its slot whereby when inserted into the combined slots of the housing member and the swivel hub member it will have lateral space for bending with the rotational movement required and for means at the opposite corners of the slot to reduce friction to the rope moving, in effect, through the housing member, means for further impeding, or actually, stopping movement on the rope by implementation of a drag bar pivotally placed within the housing member as a brake on the rope near the entrance point activated on the outside of the housing member by a lock turning knob linked to the drag bar by means calculated to put pressure on rope via the drag bar or to relieve pressure on the rope, hand holds at the sides of the housing member, auxiliary braking means attached to hand hold linked to a brake bar pivotally attached within the housing member with its braking end near the exit point of the rope, rope guides outside the top and bottom rope exit and entrance points of the housing member slot, a seat attached to the housing member by extension members.

2. The lowering device of claim 1 wherein the rope swivel hub, placed within the unit housing and of substantially cylindrical shape with a shank extending axially from one end to engage the said lock handle on the outside of the unit housing, features a groove defined about its circumference and a slot transversing and bifurcating the diameter of the cylinder and terminating at the groove where roller pins, placed horizontally on symetrically opposite corners of the groove where it meets the slot, helps to alleviate frictional wear on the rope and, in combination with the circumferential groove and the transversal slot, traps and holds the rope element within the unit housing and allows the unit to move at a safe speed down the rope when turned to any selected point on said arc on the outside face of the unit housing by the said lock handle and locked in place.

3. The lowering device of claim 1 wherein the rope drag bar, a flat elongated bar which describes an arched shape from its upper end, which is pivotally attached to the cavity walls inside the unit housing, to its other end near the rope entrance point, is mechanically activated laterally to put constant consistent pressure on the rope element at said rope entrance point by linkage members from a central point on the drag bar to the said lock turning knob on the outside of the unit housing.

4. The lowering device of claim 1 wherein the rope swivel hub within the unit housing extends a shank from one end along its axis to outside the unit housing permanently engaging the said lock handle whose function is to turn an arrow, or pointer, on its top extremity to one of several places on a said arc or dial on the outside face of the unit housing predetermined to be the right angle for the rope swivel hub to assume for a rider in a certain weight category to have a safe descent at a reasonable speed with constant speed assured by combined means on the arc and the lock handle to make the lock handle immovable at that point.

5. The lowering device of claim 2 wherein the friction wear on the rope is reduced by the addition of roller pins on symetrically opposite corners of the slot transversing the diameter of the swivel hub where it coincides with the circumferential groove.

6. The lowering device of claim 1 wherein the rope bending action of the swivel hub and the controlled pressure action of the rope drag bar combine at the rope entrance region of the unit housing to control the descending speed of the unit.

* * * * *